United States Patent [19]

Johnson

[11] 4,255,952

[45] Mar. 17, 1981

[54] WASHING MACHINE TRANSMISSION

[75] Inventor: Roger N. Johnson, Hagaman, N.Y.

[73] Assignee: General Electric Company, Louisville, Ky.

[21] Appl. No.: 83,435

[22] Filed: Oct. 10, 1979

[51] Int. Cl.[3] ..... D06F 37/40

[52] U.S. Cl. ..... 68/23.7; 74/421 R; 192/18 R

[58] Field of Search ..... 68/23.6, 23.7; 192/18 R, 18 B; 74/789, 414, 415, 421 R, 421 A

[56] References Cited

U.S. PATENT DOCUMENTS

| | | | |
|---|---|---|---|
| 1,925,474 | 9/1933 | Wilsing | 192/18 R X |
| 2,040,654 | 5/1936 | Hougland | 74/665 K |
| 2,200,870 | 5/1940 | Armbruster | 68/23.7 X |
| 2,301,046 | 11/1942 | Henderson | 68/23.7 |
| 2,503,027 | 4/1950 | Christian | 74/421 A |
| 2,609,697 | 9/1952 | Ruscoe | 68/23.7 X |
| 2,656,702 | 10/1953 | Chapin | 68/23.7 X |
| 2,674,868 | 4/1954 | Williams | 68/23.7 |
| 2,844,225 | 7/1958 | Hubbard et al. | 68/23.7 X |
| 2,947,159 | 8/1960 | Fernandez | 68/23.7 |
| 2,964,974 | 12/1960 | Loutrel | 68/23.7 X |
| 3,216,226 | 11/1965 | Alger et al. | 68/23 R |
| 3,216,227 | 11/1965 | Alger et al. | 68/23.7 |
| 3,264,847 | 8/1966 | Johnson et al. | 68/23.7 |
| 3,324,690 | 6/1967 | Button | 68/23.7 |
| 3,584,482 | 6/1971 | Brucken | 68/23 R |
| 3,783,652 | 1/1974 | Archbold | 68/23.7 |
| 3,838,755 | 10/1974 | Cochran et al. | 188/166 |
| 3,845,642 | 11/1974 | Cochran | 68/23.7 |

*Primary Examiner*—Philip R. Coe
*Attorney, Agent, or Firm*—Radford M. Reams

[57] ABSTRACT

A transmission is disclosed for providing drive to a washing machine agitator and basket to produce slow speed agitator oscillation and relatively high speed rotation of the basket for spin extraction. The transmission input shaft is driven by a drive motor and operated for either reversing or unidirectional rotation to produce the agitator oscillation and basket spin, respectively. The input shaft is drivingly connected to an agitator power shaft through reduction gearing carried in a gear case, while the gear case is secured to the washing machine basket. A clutch-brake arrangement alternatively causes braking of the gear case to the transmission housing or couples the gear case to the input shaft to produce the high speed drive of the basket through the gear case, or alternatively producing a low speed oscillation of the agitator by drive through the reduction gearing.

10 Claims, 6 Drawing Figures

WASHING MACHINE TRANSMISSION

BACKGROUND DISCUSSION

This invention concerns mechanical transmissions and more particularly transmissions adapted to drive washing machine components.

Modern washing machines typically are arranged with an extraction basket disposed within an outer surrounding tub, with an agitator disposed within the interior of the basket. The washing and rinsing action is achieved by slow oscillation of the agitator, with the items to be washed dispersed in a washing solution contained within the tub and basket.

In order to provide centrifugal extraction of the washing solution after wash and rinse cycles, the basket is spun at a relatively high rate of rotation. The agitator and basket have been driven in certain prior art designs by a highly satisfactory arrangement including an electric motor driving the input of a washing machine transmission, which transmission provides both outputs necessary to achieve the high speed basket spin and the low speed oscillation of the agitator.

Such an arrangement and transmission is disclosed in U.S. Pat. No. 2,844,225, assigned to the assignee of the present application.

The transmission includes clutching producing a low speed oscillation of an output shaft in the first direction of rotation of the motor, which output is connected to an agitator power shaft. In the opposite direction of rotation of the drive motor, the clutching arrangement produces a direct drive to the basket in order to carry out centrifugal extraction.

The oscillatory output is achieved by a mechanical motion which typically involves reciprocation of a gear rack which in turn produces the output oscillation of a pinion gear in mesh with the gear rack. This design has been highly successful and employed for many years in commercial washing machines.

The use of a mechanical movement in order to achieve the conversion of rotation to oscillation of the drive input to the agitator power shaft necessitates rather complex components which represent a significant cost item.

Other approaches to providing oscillatory drive for washing machines have included the use of a reversing electric motor as described in U.S. Pat. No. 2,656,702.

More recently, there has been proposed the utilization of a particular drive motor design which may be commutated in order to produce either unidirectional rotation or cyclically reversing rotational motion. Such capability of the drive motor creates the possibility of providing a direct drive to achieving spin of the basket and oscillation of the agitator by the single electric motor. Even with such motor design, a suitable transmission must be employed in order to provide a direct high speed drive to the basket, while providing a reduced drive of the drive motor to the agitator to produce a reduced speed oscillation.

Since with this type of drive the reversal of the direction of drive cannot be used to produce shifting between the oscillatory and the spin drive modes, it is necessary to provide a separate shifting mechanism. It is advantageous to provide such shifting mechanism which is located externally of the transmission housing in order to eliminate the need for separate sealing of the control levers, etc.

It is important for such home applicance applications to provide a relatively low cost, simple and reliable structure such as to realize the potential advantage of lowering of cost by the use of such a reversing electrical motor, while insuring adequate reliability of the transmission.

An additional consideration in the design of such transmissions is the inertia of the rotating parts exhibited during oscillation of the drive, since the rapid reversal of the motor renders the inertia load relatively significant on those components driven during the agitation cycle.

Accordingly, it is an object of the present invention to provide a washing machine transmission providing an output drive to the washing machine basket and agitator, respectively, adapted to be driven by an input drive motor which is operated to produce unidirectional rotation or cyclically reversing rotation to produce oscillation of the agitator in the agitation mode and relatively high speed rotation of the basket during the spin extraction operation.

It is a further object of the present invention to provide such a washing machine transmission in which the shift between the spin and agitate modes is executed by a shifter arrangement which is located externally of the transmission housing.

It is still a further object of the present invention to provide such a washing machine transmission which is relatively simple in configuration.

SUMMARY OF THE INVENTION

These and other objects of the present invention, which will become apparent upon a reading of the following specification and claims, are achieved by an arrangement including a transmission having an input shaft directly coupled to a drive motor alternatively providing either a unidirectional or reversing rotation output. The transmission drives the agitator through reduction gearing including an input drive pinion driven by the input shaft and driving an output shaft gear through an intermediate, speed reducing stepped gear. The reduction gearing is carried in a gear case rotatably supported in a stationary transmission housing, the gear case connected to the washing machine basket and keyed to a tubular input pinion bushing extending from one side of the gear case. The tubular input pinion bushing receives and rotatably supports the input shaft.

A clutch-brake arrangement is provided in which a slidable clutch-brake coupling member is moved between first and second axially shifted positions corresponding to agitator or spin drive modes of the transmission. The coupling member is rotatably connected to the input pinion bushing while being slidable thereon between the first and second positions so as to rotate together therewith in either position of the clutch-brake coupling member.

In the first or agitate position of the coupling member, the gear case and connected basket are positively braked by means of mating teeth formed on the coupling member and the stationary transmission housing.

In the second or spin position, the coupling member is slid out of engagement with the brake teeth and into engagement with mating clutch surfaces formed on the coupling member and the input shaft to form a driving connection between the input shaft and the input pinion bushing (and connected gear case).

This establishes a direct drive to the gear casing, causing the entire assembly, including the agitator and basket, to be rotated at a relatively high speed by the drive motor.

The coupling is located on a portion of the input pinion bushing protruding out from the transmission, such that the coupling member is disposed exteriorly of the transmission housing. The shifting between modes is achieved by a short axial shifting of the coupling member by sliding along the protruding end of the input pinion bushing.

The agitator power shaft is received and rotates within a spin tube secured to the opposite side of the gear case, the spin tube thereby providing a connection between the basket and the gear case.

The output shaft gear of the reduction gearing has an internal bore formed therein receiving one end of the agitator power shaft, which is also keyed therein so as to be rotated by the reduction gearing. The output shaft gear bore also receives one end of the input shaft and is supported in a bushing disposed in the bore formed in the output shaft gear.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
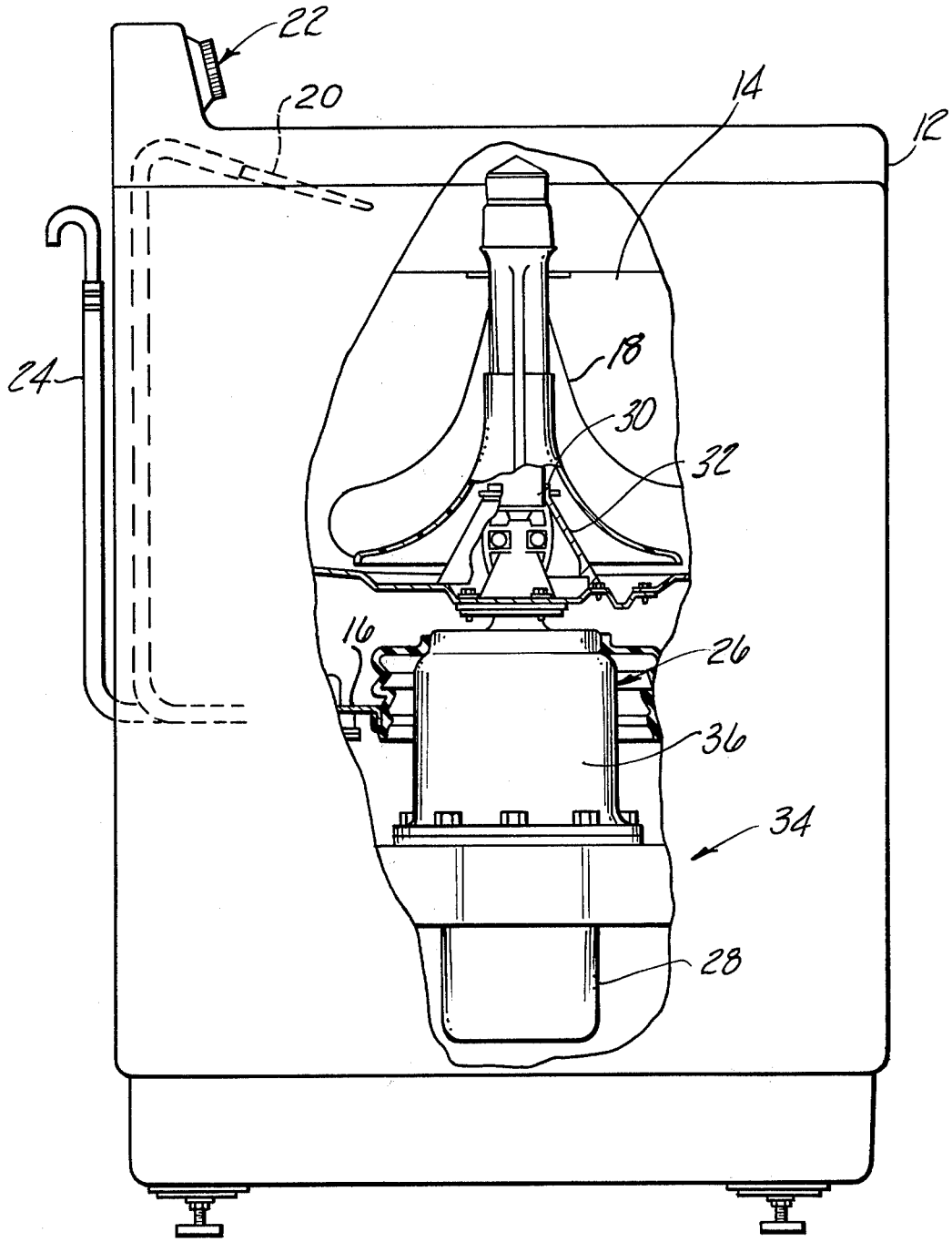
FIG. 1 is a side elevational view of a washing machine with a portion of the external cabinetry broken away to reveal the installation of the washing machine transmission according to the present invention.

Referring to the drawings and particularly to FIG. 1, the transmission according to the present invention has particular application to a conventional washing machine 10 which includes external cabinetry 12, within which is mounted the major components. These include a washing machine basket 14, mounted within an outer tub 16, and an agitator 18 mounted in turn within the interior of the washing machine basket 14.

The washing machine also includes means for introducing wash and rinse water through an inlet 20, under the control of the machine controls depicted generally at 22, and also a drain 24 serving to receive the water drained from the outer tub 16 after each wash and rinse cycle.

The agitator 18 is oscillated in order to achieve washing and rinsing action in the basket 14 by the resulting agitation of the wash water and items to be washed disposed therein. The basket 14 is rotated at a relatively higher speed in order to extract the water from the clothing items, causing water to move outwardly into the outer tub 16 and thus through the drain 24 in a manner well known to those skilled in the art.

The drive arrangement for the agitator 18 and basket 14 includes a transmission 26 according to the present invention, driven by an electric drive motor 28, both of which are supported in the lower region of the external cabinetry 12 on a cross member 34, i.e., below the bottom of the outer tub 16, as will be hereinafter disclosed.

Figure 2:
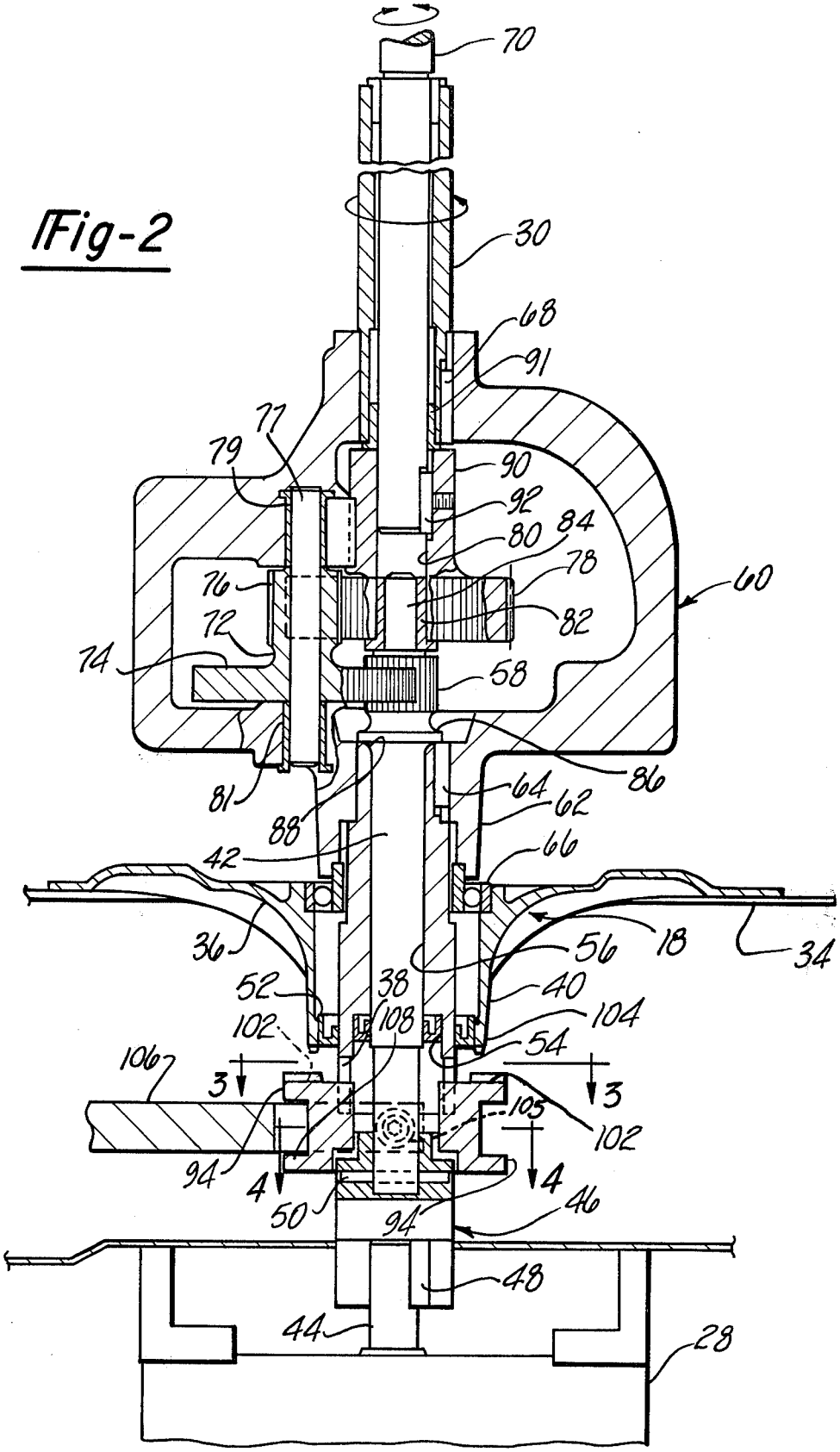
FIG. 2 is an enlarged partially sectional view of the transmission depicted in FIG. 1.
Figure 3:
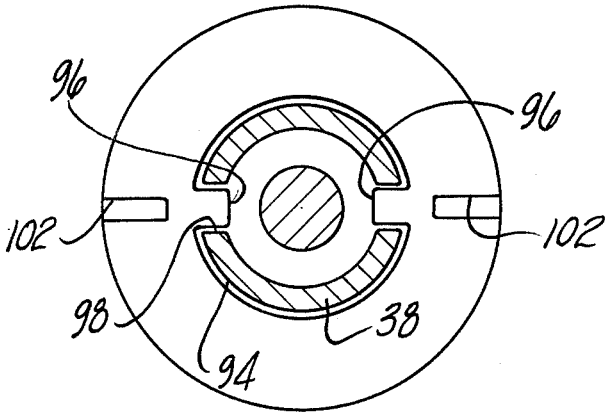
FIG. 3 is a view of the section 3—3 taken in FIG. 2.
Figure 4:
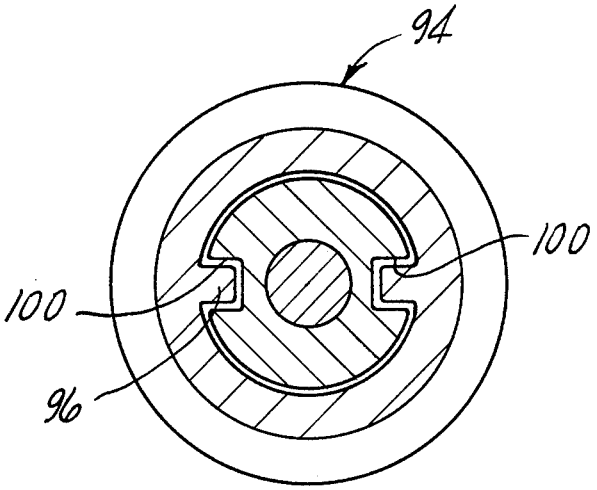
FIG. 4 is a view of the section 4—4 taken in FIG. 2.
Figure 5:
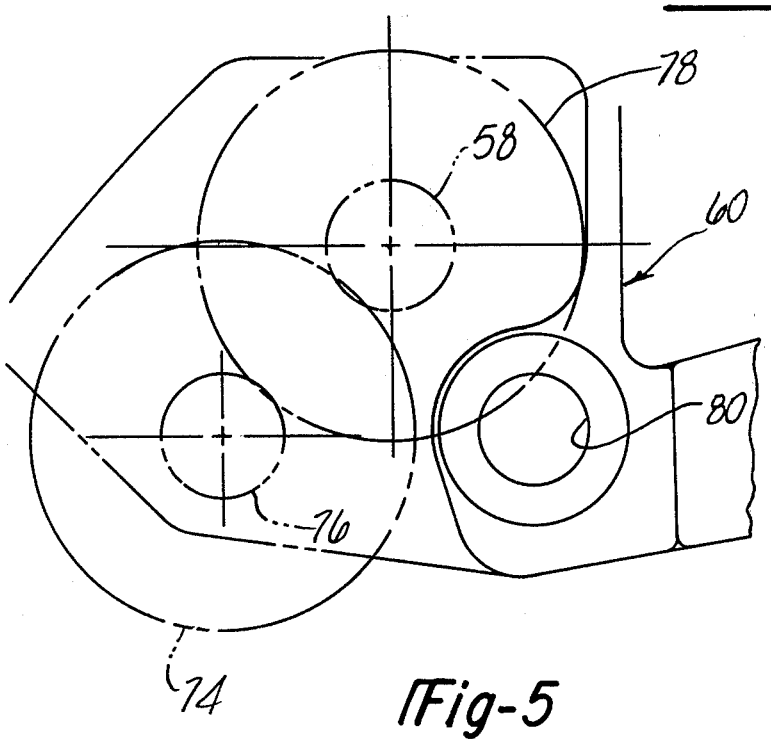
FIG. 5 is a diagrammatic plan view of the gear reduction arrangement included in the transmission depicted in FIG. 2.
Figure 6:
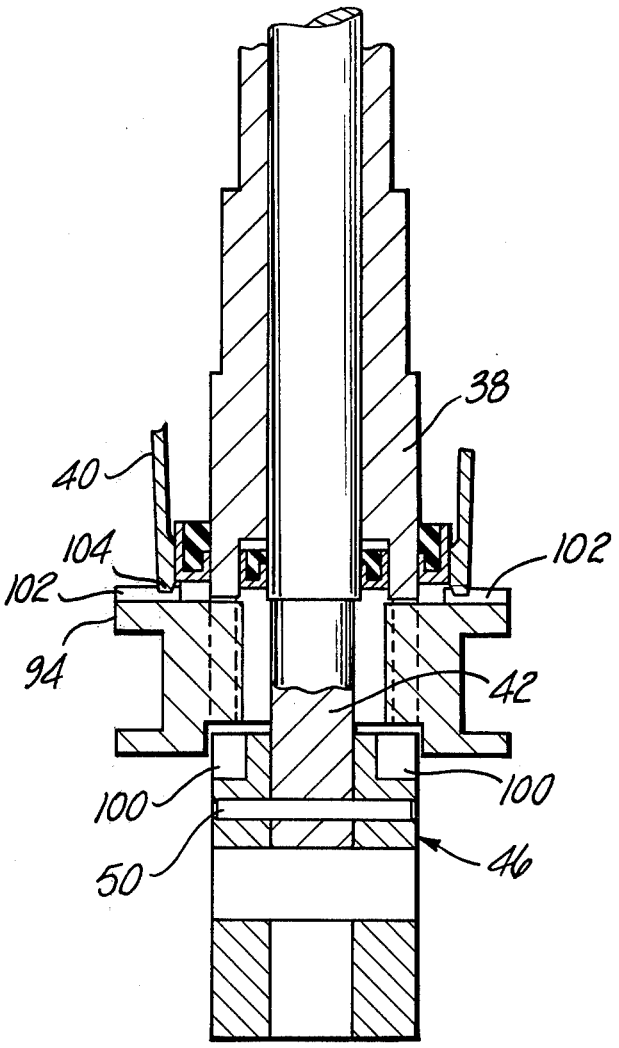
FIG. 6 is a fragmentary partially sectional view of the transmission shown in FIG. 2 with the coupling member shifted from the agitate position shown in FIG. 2 to the spin-drive position.

The transmission 26 includes two separate output shaft means including a spin tube 30 and an agitator power shaft which in FIG. 1 is disposed within the spin tube 30, but is indicated in FIG. 2 at reference numeral 72 and which is connected to the agitator 18 while the spin tube 30 is connected to the basket 14 with a conventional clamp-on coupling 32.

The drive motor 28 is preferably of a type having two modes of operation; a first mode in which the motor rotation is rapidly reversed to oscillate; and, in a second mode operates to rotate unidirectionally. These respective modes, when transmitted through the transmission, produce corresponding motions of the agitator power shaft and spin tube 30 to produce the agitator oscillation and basket spin, respectively.

Suitable motors of this type are disclosed in copending applications, Ser. No. 077,784, filed Sept. 21, 1979, entitled "Electronically Commutated Motor, Stationary Assembly and Rotatable Assembly Therefor, Lamination, Method of Making a Core, Laundry Machine, Transmission Mechanism and Drive Therefor;" and Ser. No. 077,776, filed Sept. 21, 1979, entitled "Control System for ECM Drive Laundry Machine."

These applications disclose DC motors which are electronically commutated such as to produce the aforementioned modes of operation.

Other examples of such electronically commutated DC motors are disclosed in U.S. Pat. Nos. 4,005,347 and 4,015,182.

The entire drive assembly is mounted on a suspension system including a cross member 34.

Referring to FIGS. 1 through 6, the transmission 26 includes a transmission housing 36 mounted as noted to the cross member 34. Rotatably mounted within the transmission housing 36 is a tubular input pinion bushing 38, extending out through tubular protrusion 40 formed on the transmission housing 36. The input pinion bushing 38 has an end portion which protrudes, as shown in FIG. 2, out to the exterior of the fixed transmission housing 36.

Mounted within the input pinion bushing 38 is an input pinion shaft 42, which is rotatably joined to the drive shaft 44 of the drive motor 28 by means of a coupling 46 secured to the drive shaft 44 by a key 48, and to the input pinion shaft 42 by means of a shear pin 50.

Seals 52 and 54 are provided mounted over the input pinion bushing 38 and the input pinion shaft 42, respectively, to allow the interior of the transmission 26 to be filled with lubricant in accordance with conventional practice.

As noted, the input pinion shaft 42 is rotatably mounted within a bore 56 formed within the input pinion bushing 38 and is formed at one end with an input pinion gear 58 located within a gear case 60.

The input pinion bushing 38 is secured to a tubular extension 62 of gear case 60 by means of a key 64 such as to be securely joined thereto. The tubular extension 62 in turn is rotatably supported on a bearing 66.

The other side of the gear case 60 is rotatably joined to the spin tube 30 by means of a key 68, such that the input pinion bushing 38, gear case 60 and spin tube 30 are all rotatably connected to rotate together as a unit.

Contrariwise, the input pinion shaft 42 and the agitator power shaft 70 are drivingly interconnected by a gear reduction means comprising spur gears mounted to the gear case 60. These include the input pinion gear 58 machined integral with the input pinion shaft 42 and also including a stepped spur gear 72 having a large diameter section 74 in mesh with input pinion gear 58 and a small diameter pinion gear 76 in mesh with an output shaft gear 78.

The output shaft gear 78 is formed with an internal bore 80 receiving a bushing 82 which in turn receives a piloting end portion 84 of input pinion shaft 42 to help ensure proper meshing of gears. Together with the shoulder 86 formed on the input pinion shaft 42 and the end face 88 of the input pinion bushing 38, this axially locates the input pinion shaft 42.

Output shaft gear 78 is formed with a hub portion 90 which is keyed at 92 to the agitator power shaft 70 to be rotatably connected thereto.

The gear reduction is thus in two stages, with the first reduction between the input pinion gear 58 and the relatively large diameter section 74 of the stepped spur gear 72; the second reduction occurring between the small diameter section 76 of the stepped spur gear 72 and the relatively large output shaft gear 78. An overall reduction on the order of 12:1 is easily obtainable by this arrangement to provide a gear reduction drivingly interconnecting input pinion shaft 42 and agitator power shaft 70.

The transmission can be driven in either of two modes in which drive is either through the input pinion bushing 38 via the gear case 60 through the spin tube 30 and to the basket 14; or through the input pinion shaft 42 and the gear reduction means mounted on the gear case 60 to the agitator power shaft 70.

In the first mode, the drive ratio is direct to the basket 14 and in the second mode there is a reduction in the drive ratio afforded by the gear set interconnecting the input pinion shaft 42 and the agitator power shaft 70 as noted.

The stepped spur gear 72 is rotatably supported on an axle pin 77 rotatably mounted within the gear case 60 by bearings 79 and 81. The output gear 78 hub portion is rotatably supported on the end of the agitator power shaft 70, in turn supported on a sleeve bearing 91.

The control over the mode of drive through the transmission is afforded by the provision of clutch-brake means including a coupling member 94 which is slidably mounted on a protruding end portion of the input pinion bushing 38 while being rotatably connected thereto by means of a keyed connection afforded by a pair of extending ribs 96 disposed in corresponding slots 98 on the input pinion bushing 38.

The ribs 96 may also be moved into registry with corresponding slots 100 formed in the end of the coupling 46 rotatably connected to the drive shaft 44, as shown in FIG. 2.

Also formed on the coupling member is a pair of radially extending slots 102 which are movable into registry with a series of brake teeth 104 formed about the end of transmission housing 36.

In the first axial position of the coupling member 94, the slots 102 are positioned in engagement with the brake teeth 104, thereby holding the input pinion bushing 38, as well as the connected gear case 60, spin tube 30 and basket 14 stationary.

In the second axially shifted position of the clutch-brake coupling member 94, the input pinion bushing 38 is released and connected to a drive shaft 44 and input pinion shaft 42 by movement of the ribs 96 into the slots 100 formed in the coupling 46.

The axial position of the clutch-brake coupling member 94 is controlled by a shift lever 106 which carries ball bearing elements 105 engaged within an annular recess 108 formed on the exterior of the clutch-brake coupling member 94. Shift lever 106 in turn is shifted by means of a suitable solenoid operator (not shown). The machine controls (not shown) produce shifting of the lever 106 in synchronism with a change in the drive mode of the drive motor 28 to provide either agitation or spin.

Accordingly, in the first axial position of the clutch-brake coupling member 94, the drive through the transmission is in the first mode in which drive motor 28 is drivingly connected to the agitator power shaft 70 by reduction gearing means carried by the gear case 60 which provides a reduced drive therebetween.

The reduction action of the drive motor 28 produces a corresponding oscillation of the agitator 18 at a greatly reduced rate of rotation. At this time, the basket 14 is restrained against rotation by means of the coupling member 94 being in engagement with the transmission housing 36 by interengagement with the slots 102 and the brake teeth 104, to absorb the reaction of the gear reduction mounted within the gear case 60.

Upon shifting movement of the clutch-brake coupling member 94 to the lower position as shown in FIG. 2, the input pinion bushing 38 is released for rotation by disengagement of the slots 102 and the brake teeth 104 and is connected to the coupling 46 by the engagement of the ribs 96 in the slots 100. Thus, there is established a driving connection between the drive shaft 44 to the gear case 60 as well as to the spin tube 30 and the basket 14.

The drive motor 28 is rotated unidirectionally in this mode and with the one-to-one ratio established, the basket 14 is rotated at relatively high speed necessary during the extraction cycle.

It can be seen that the overall arrangement is relatively simple, i.e., a first input shaft coupled to the drive motor; gear reduction means carried by a gear case housing driven by the input shaft; and with the output of the gear reduction means driving the agitator power shaft, and the gear case connected to the basket.

Thus, drive may be controlled by providing a clutch-brake means which alternately either brakes the gear case to enable drive through the reduction gearing to the agitator power shaft at a reduced rate of rotation of the drive motor, or to release the gear case and couple the same to the input drive thereby driving the agitator and basket at direct drive ratio rotational speed.

This transmission has a similar overall configuration to mechanical movement type transmissions to enable generally similar components to be employed in similar installations, but this transmission offers the advantage of eliminating the mechanical movement type oscillatory drive when using a reversing drive motor of the type described.

While the transmission has been described as providing a drive between a washing machine drive motor and either the agitator or basket as driven loads, it may be useful in other drive applications in which such drive connections are required to first and second loads.

The embodiments of the invention in which an exclusive property or privilege is claimed are defined as follows:

1. A transmission for coupling a rotary input drive selectively to first and second driven loads, the transmission comprising:

a rotatable input shaft;

gearing means driven by said input shaft and including an output member;

a rotatable gear case mounting said gearing means;

a transmission housing enclosing said gear case and said gearing means;

first means extending from said housing for connecting said output member to the first of the driven loads;

second means extending from said housing for connecting said gear case to the second of the driven loads;

said input shaft extending from said housing for connection to the rotary input drive so that the first load is driven from the input drive through said gearing means;

a tubular member connected to said gear case and protruding from said housing about said input shaft;

clutch brake means including a clutch brake coupling member movable between first and second axial shifted positions relative to the protruding portion of said tubular member; said coupling member being effective in its first axial position to cause said gear case to be braked against rotation and in its second axial position to cause said gear case to be drivenly connected to the rotary input drive so that said second load is driven from said input drive through said gear case only when said coupling member is in its second axial shifted position.

2. The transmission according to claim 1 wherein said gearing means comprises gear reduction means whereby said input shaft means drives said output member at a reduced rate of rotation.

3. The transmission according to claim 1 wherein said gearing means includes an input pinion gear driven by said input shaft means and a stepped gear including a relatively larger diameter gear portion driven by said input pinion and a relatively smaller diameter gear portion, and wherein said output member comprises an output gear of relatively larger diameter than said smaller diameter gear portion of said stepped gear and in driven relationship therewith, whereby said gearing means provides two reductions in rotation speed between said input shaft and said output member.

4. The transmission according to claim 3 wherein said output gear, said input pinion gear and said input shaft are axially aligned and said stepped gear is mounted for rotation in said gear casing about an axis parallel to the axis of rotation of said output gear, said input pinion gear and said input shaft means.

5. The transmission according to claim 4 wherein said output gear is formed with an internal bore and wherein said input shaft means includes a pilot end section disposed within said bore and further including means rotatably supporting said pilot section within said bore so that said output member is supported on said pilot section of said input shaft means.

6. The transmission according to claim 1 wherein said clutch brake means includes means mounting said coupling member for selective slidable movement axially of said tubular member between the first and second axial shifted positions of said coupling member and joining said coupling member to said tubular member for rotatable movement therewith; said coupling member and said transmission housing having a cooperative tooth and slot in arrangement which is engaged when said coupling member is in its first axial position so that said coupling member is rendered stationary and provides braking of said gear case, said tooth and slot arrangement being out of engagement when said coupling member is in its second axial position to release braking of said gear case; and said coupling member and said rotary input drive having a cooperative tooth and slot arrangement which is engaged when said coupling member is in its second axial position to establish a rotation driving connection therebetween.

7. The transmission according to claim 6 wherein:

said clutch brake coupling member comprises an annular member mounted about said tubular member and having longitudinally extending ribs; said tubular member having longitudinally extending slots receiving said ribs for providing the axially sliding and rotatably joined connection therebetween; and wherein said transmission housing includes a tubular protrusion concentric to said coupling member and positioned about said tubular member, said tubular protrusion including radially extending brake teeth projecting toward said annular coupling member, and wherein said annular coupling member is formed with radially extending recesses movable into engagement with said brake teeth to provide rotative braking of said coupling member.

8. In a washing machine of the type including a tub, a basket disposed within said tub and an agitator disposed within said basket, a drive arrangement for producing unidirectional rotation of basket and rotational oscillation of said agitator at a reduced rate of rotation, said drive arrangement comprising:

a drive motor including an output shaft operable in a first mode of operation of said motor to have a unidirectional rotation and in a second mode of operation of said motor to have a cyclically reversing rotation;

a transmission drivingly interconnecting said motor output shaft with said basket and agitator, respectively, said transmission including;

an input shaft;

gear reduction means driven by said input shaft and including an output member;

a rotatable gear case mounting said gear reduction means;

a transmission housing enclosing said gear case and said gear reduction means;

first means extending from said housing for coupling said output member to said agitator;

second means extending from said housing for coupling said gear case to said basket;

said input shaft extending from said housing for coupling to said motor output shaft so that said agitator is driven through said gear reduction means at a reduced rate of rotation relative to said motor output shaft;

a tubular member connected to said gear case and protruding from said housing about said input shaft;

clutch brake means including a clutch brake coupling member movable between first and second axial shifted positions relative to the protruding portion of said tubular member; said coupling member being effective, in its first axial position, to cause said gear case to be braked against rotation and, in its second axial position, to cause said gear case to be drivenly coupled to said motor output shaft so that said basket is rotated through said gear case only when said coupling member is in its second axial position.

9. The washing machine according to claim 8 wherein said clutch brake means includes means mounting said coupling member for selective slidable movement axially of said tubular member between the first and second axial shifted positions of said coupling member and joining said coupling member to said tubular member for rotatable movement therewith; said coupling member and said transmission housing having a cooperative tooth and slot arrangement which is engaged when said coupling member is in its first axial position so that said coupling member is rendered stationary and provides braking of said gear case, said tooth and slot arrangement being out of engagement when said coupling member is in its second axial position to release the braking of said gear case; a drive input member is connected to said motor output shaft for rotation therewith; said coupling member and said drive output member having a cooperative tooth and slot arrangement which is engaged when said coupling member is in its second axial position to establish a rotative driving connection therebetween.

10. The washing machine according to claim 9 wherein said clutch brake coupling member comprises an annular member mounted about said tubular member and with longitudinally extending ribs and said tubular member having longitudinally extending slots receiving said ribs for providing the axially sliding and rotatably joined connection therebetween; and wherein said transmission housing includes a tubular protrusion concentric to said coupling member and positioned about said tubular member; said tubular protrusion including radially extending brake teeth projecting toward said annular coupling member; and wherein said annular coupling member is formed with radially extending recesses movable into engagement with said brake teeth to provide rotative braking of said coupling member.

* * * * *